US010458136B2

(12) United States Patent
Lochtefeld et al.

(10) Patent No.: US 10,458,136 B2
(45) Date of Patent: Oct. 29, 2019

(54) METHOD AND APPARATUS FOR PRODUCING WAVES SUITABLE FOR SURFING USING WAVE-FORMING CAISSONS WITH FLOATING WAVE ATTENUATOR

(71) Applicants: Thomas J. Lochtefeld, La Jolla, CA (US); Dirk Bastenhof, Ede (NL)

(72) Inventors: Thomas J. Lochtefeld, La Jolla, CA (US); Dirk Bastenhof, Ede (NL)

( * ) Notice: Subject to any disclaimer, the term of this patent is extended or adjusted under 35 U.S.C. 154(b) by 787 days.

(21) Appl. No.: 14/833,749

(22) Filed: Aug. 24, 2015

(65) Prior Publication Data

US 2016/0053504 A1 Feb. 25, 2016

Related U.S. Application Data

(60) Provisional application No. 62/041,406, filed on Aug. 25, 2014.

(51) Int. Cl.
*E04H 4/00* (2006.01)

(52) U.S. Cl.
CPC ..... *E04H 4/0006* (2013.01)

(58) Field of Classification Search
CPC ..... E04H 4/0006; A63B 69/14
USPC ..... 4/491
See application file for complete search history.

(56) References Cited

U.S. PATENT DOCUMENTS 3,005,207 A 10/1961 Matrai
3,350,724 A 11/1967 Leigh
3,473,334 A 10/1969 Dexter
3,562,823 A 2/1971 Koster
4,062,192 A 12/1977 Biewer
4,276,664 A * 7/1981 Baker ..... E04H 4/0006 4/491
4,515,500 A 5/1985 Bastenhof
4,522,535 A 6/1985 Bastenhof
4,805,896 A 2/1989 Moody
4,905,987 A 3/1990 Frenzi
4,976,570 A 12/1990 Davis et al.
5,226,747 A * 7/1993 Wang ..... E04H 4/0006 4/491
5,342,145 A 8/1994 Cohen
5,401,117 A 3/1995 Lochtefeld
5,833,393 A 11/1998 Cornahan
6,241,422 B1 6/2001 Makowski
6,336,771 B1 1/2002 Hill
6,460,201 B1 10/2002 Lochtefeld
(Continued)

*Primary Examiner* — Lauren A Crane
(74) *Attorney, Agent, or Firm* — J. John Shimazaki

(57) ABSTRACT

A wave generator for a wave pool with a floating attenuator housed within a caisson compartment that has mass, density and weight characteristics that enable it to remain substantially in contact with the top surface of the water in the compartment. Additional mechanisms are provided which help to keep the attenuator in a substantially horizontal orientation within the caisson, such that unwanted wave motions and water movements within the caisson compartment can be substantially reduced or eliminated. These mechanisms include the adaptation of a vertical post within the compartment and cable and pulley systems that are designed to help control the up and down movement of the attenuator as it travels up and down within the compartment.

13 Claims, 7 Drawing Sheets

(56) References Cited

U.S. PATENT DOCUMENTS

| | | | |
|---|---|---|---|
| 8,561,221 | B2 | 10/2013 | Lochtefeld |
| 2014/0105685 | A1 | 4/2014 | McFarland |

* cited by examiner

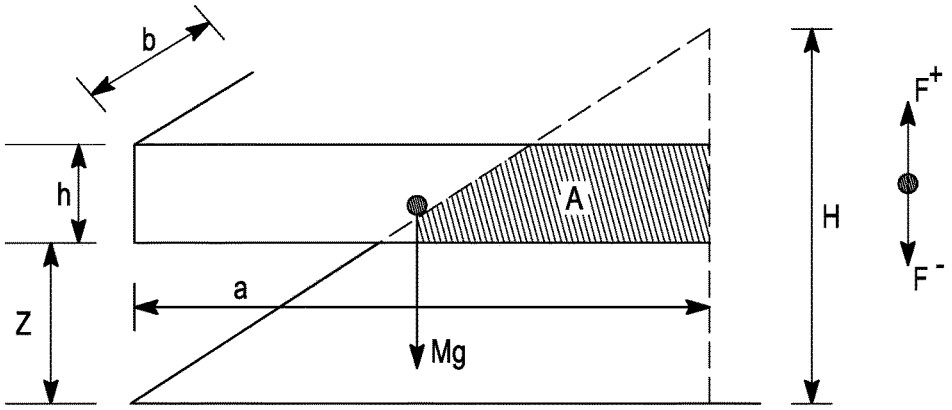

$$A = a * h * (1 - \frac{Z}{H} - \frac{1}{2} * \frac{h}{H})$$

$$F^{+} = e * g * A * b = \quad e * g * a * h * (1 - \frac{Z}{H} - \frac{1}{2} * \frac{h}{H}) * b$$

$$F^{-} = M * g = \bar{e}_p * a * b * h * g$$

$$F^{+} = F^{-}$$

$$\therefore \; e * g * a * b * h * (1 - \frac{Z}{H} - \frac{1}{2} * \frac{h}{H}) = \bar{e}_p * a * b * h * g$$

$$\therefore \; e * (1 - \frac{Z}{H} - \frac{1}{2} * \frac{Z}{H}) = \bar{e}_p \frac{h}{H})$$

*FIG. 7*

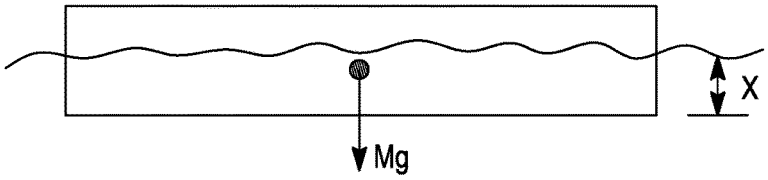

at rest: $Mg = a * b * x * e * g \quad \Rightarrow \bar{e}_p * h = e * x$ or: $\bar{e}_p = e * \frac{x}{h}$ $$\therefore \; (1 - \frac{Z}{H} - \frac{1}{2} * \frac{h}{H}) = \frac{x}{h}$$

For $z = 0$ and $\frac{x}{h} = \frac{2}{3} \Rightarrow 1 - \frac{Z}{H} - \frac{x}{h} = \frac{1}{2} * \frac{h}{H}$ $$\therefore \; 2H * (1 - \frac{Z}{H} - \frac{x}{h}) = h \Rightarrow h = \frac{2}{3} H$$

*FIG. 8*

METHOD AND APPARATUS FOR PRODUCING WAVES SUITABLE FOR SURFING USING WAVE-FORMING CAISSONS WITH FLOATING WAVE ATTENUATOR

RELATED APPLICATION

This application claims the benefit of the filing date of U.S. Provisional Application Ser. No. 62/041,406, filed on Aug. 25, 2014.

FIELD OF THE INVENTION

The invention relates to the field of wave pools, and in particular, to wave pools powered by wave generators that comprise multiple caissons each having a floating attenuator mechanism to reduce or dampen the unwanted wave action that can otherwise occur within each caisson as the wave generators are operated to create waves.

BACKGROUND OF THE INVENTION

Conventional wave pools generally have a relatively deep end and a relatively shallow end, with one or more wave generators located along the deep end, and a sloped shoreline along the shallow end upon which the waves break. When multiple wave generators are used to create these waves, they are typically positioned side by side, wherein each one is normally designed with a compartment for holding water, and a mechanism to drive the water in the compartment down and forward, which can cause water to be pushed forward in front of each wave generator to produce the waves.

One problem, however, associated with previous wave generators of this type is that the water inside the wave generating compartment or caisson tends to heave, sway, and surge as the water is being forced down and forward into the pool, which can have a negative effect on the creation of the resultant waves, wherein internal reflections can further exacerbate the water surface inside the caisson. This internal caisson water movement can have the effect of creating turbulence and unwanted wave action along the surface of the water within the compartment, which can ultimately result in differential forward water velocity vectors which can make it difficult to create smooth resultant waves. In addition to creating internal standing waves, upward and side pressures can also be created inside the compartment, which can cause the water to "slosh" around inside the caisson, which can result in undue turbulence and varied emission velocities, which in turn, can negatively affect the formation of smooth resultant waves in the pool.

Notwithstanding past attempts to create surfable waves in wave pools of this type, what is now needed is a wave generator designed to reduce, dampen, or even eliminate these unwanted internal caisson wave movements, including a mechanism that can be easily incorporated into standard wave generator designs, wherein existing wave generators of the kind discussed herein can be adapted and modified to help reduce and eliminate these unwanted water movements in the caisson.

SUMMARY OF THE INVENTION

Generally speaking, the wave generators of the present invention preferably comprise multiple caissons positioned side by side, wherein each caisson is preferably in the shape of a rectangular box having a front wall, back wall, side walls, floor and ceiling, wherein the front wall has an opening at the bottom that allows water to be pushed down and forward into the wave pool to create the waves. Other configurations, such as circular or square shaped caissons are also possible.

When pneumatic wave generators of this type are used, the upper part of each caisson, such as along the top edge of the back wall, is often provided with an opening that allows air to be introduced into and out of the caisson, such as by virtue of a fan, blower or pump mechanism, etc. Thus, during the charging phase, air is pumped or otherwise withdrawn from the caisson through the upper opening, which in turn, causes water to be drawn into the compartment from the pool through the front opening, thus causing the caisson to be filled to the desired level. Then, during the discharge phase, air is preferably pumped or otherwise introduced back into the compartment, such as through the same upper opening, thus causing the water column in the compartment to transition down and water to be pushed forward through the caisson front opening, wherein these movements help to create waves in the wave pool.

The present invention preferably comprises a novel design for a wave generator that uses a uniquely designed floating attenuator device that acts as a plunger or piston mechanism within the caisson that helps reduce or even prevent the formation of unwanted wave movements inside the caisson compartment, as the water column rises and drops (hereafter referred to as 'attenuator'). Preferably, each floating attenuator comprises a buoyant horizontally oriented structure that can float on top of the water column, i.e., on the surface of the water in the caisson, wherein the attenuator preferably stays in contact with the surface of the water as it moves up and down, to help prevent wave action and unwanted water movements from occurring across the width of the caisson, such that extraneous wave and water surface movements are substantially reduced or prevented, which in turn, allows for a more stable, smooth and uniformly shaped emission of water and transfer of wave energy from the compartment into the wave pool.

The purpose of the attenuator is to keep the surface of the water in the caisson flat, thereby avoiding unwanted wave action internal to the caisson and resultant differential water column velocities propagating into the pool. This is especially helpful in cases where a pneumatic wave generator of the type described above is used, which is designed to introduce air into the caisson to push water down and out through the front opening, wherein the floating attenuator helps to calm and stay the movement of water within the caisson, such that little or no wave or water movement is transferred to the waves in the pool.

In one aspect, the floating attenuator of the present invention is preferably made of a substantially durable, rigid and buoyant material that floats on top of the water surface. In one embodiment, the attenuator is preferably made using large diameter pipes (perhaps 16" or so in diameter) that are capped and positioned side by side and connected together to form a rectangular "deck," wherein the pipes can be made from durable material, such as PVC, plastic, aluminum or other rust proof material. In another embodiment, the attenuator can be constructed using a fabricated or molded buoyant rigid foam "sheet" of material, such as one shaped in the configuration of the caisson, i.e., extended substantially across the width of the compartment, wherein the foam material can be bonded to a rigid frame, such as one made of rust-proof metal or other heavy structure to provide extra strength, rigidity and mass to the structure.

In either case, the attenuator preferably has sufficient density, mass and weight to hold a steady position internal to the caisson, such that it counteracts the varied surface wave actions and water movements that can occur within the compartment, wherein the configuration and construction of the attenuator is preferably sufficiently thick and heavy enough such that it compensates for the varied upward and side pressures that can otherwise cause surface chops, surges or standing waves to form on the water surface. In this respect, if the attenuator is designed too light, when water movements occur, the attenuator could easily be lifted up and above the internal caisson wave crests, wherein associated wave troughs can form underneath the attenuator, i.e., within the water column, wherein the function of the attenuator would then be compromised. Although buoyant, the attenuator is preferably sufficiently thick, dense and heavy enough such that it remains partially submerged within the water column, to properly remove the referenced chops/surges/standing waves, and to help maintain full contact between the bottom surface of the attenuator and the water surface, while simultaneously minimizing water splashing over the top of the attenuator.

In another aspect, the attenuator preferably consists of an additional stabilization mechanism, wherein the attenuator is preferably prevented from tilting or tipping unnecessarily, such that it can remain substantially horizontally oriented and thus help to keep the surface of the water in the compartment substantially flat. For example, keeping the attenuator and the top surface of the water column substantially flat can be accomplished by incorporating one of the following design features:

In one embodiment, a vertical guide post can be provided in the middle of the compartment wherein the post can be extended through a central hole extended through the attenuator, wherein, the association between the guide post and hole can help prevent the attenuator from tipping or tilting to one side. In general, by making the attenuator relatively thick, and extending the post through the hole with only a slight gap between them (i.e., less than one-fourth the depth of the hole), the post can help keep the attenuator in a substantially horizontal position in the caisson as the attenuator moves up and down. Although only one central post is necessary to help maintain a balanced distribution of wave energy across the compartment, in other embodiments, more than one post can be used, although preferably, the associated openings should be symmetrically located about the centerline of the attenuator, such that there is an even distribution of water and wave energy applied to the attenuator across the width of the compartment.

In an alternate embodiment, the post that extends through the center of the compartment can be a hollow tube, which can extend substantially vertically within the caisson, and which can be used as the means of introducing air into and out of the caisson, rather than having an upper opening on the back wall of the caisson as previously discussed. In such case, the tube can be extended substantially vertically upward from the bottom to almost the top of the caisson ceiling, wherein air can communicated with an associated storage tank as well as through the tube and through the space that exists between the top of the tube and caisson ceiling. Alternatively, the tube can be provided with an opening on the side of the tube near the top, through which the air can pass, in which case, the tube can be connected at the top to the caisson ceiling. In either case, the tube is preferably hollow, with an opening at or near the top, wherein the air introduced into and out of the caisson can pass directly into the caisson through the tube, rather than through an opening at the back of the caisson.

In a related embodiment, the associated storage tank for holding compressed air can be positioned under the sloped floor of the wave pool, i.e., the pool floor can be suspended over the storage tank, wherein, the tank can communicate with the caisson compartment via the tube, wherein the air in the tank can be introduced into and out of the caisson through the tube during the charging and discharge phases.

In another embodiment, rather than using a post or tube, a cable and pulley system can be provided which controls the up and down movement of the attenuator, wherein the pulleys can be secured to the caisson walls and the cables can be extended within the pulleys and secured to opposing sides of the attenuator to control the up and down movement of the attenuator. That way, the forces applied to the attenuator via the cable and pulley system can help prevent the attenuator from tilting or tipping unnecessarily, wherein the attenuator can be kept substantially horizontally oriented as the water in the compartment moves up and down.

In one cable and pulley embodiment, there are preferably multiple pulleys attached to the caisson walls and multiple cables extended within the pulleys, wherein the cables are attached to the attenuator in a manner that helps to keep the range of motion between opposing sides of the attenuator substantially synchronized, such that, due to the rigidity of the attenuator, one side of the attenuator will not move up or down without the other side of the attenuator moving up or down with it, i.e., in unison.

In another embodiment, the attenuator can be coupled to a single cable and pulley system, wherein, in this embodiment, two pulleys are preferably provided, one above the attenuator and one below, wherein the cable is preferably extended within the pulleys with one end of the cable attached to the top of the attenuator and the other end of the cable comprising two branch cables attached to the bottom of the attenuator, i.e., at locations that are equidistant from a centerline of the attenuator, wherein the range of motion between opposing sides of the attenuator can be substantially controlled and synchronized. Again, given the rigidity of the attenuator, and the even distribution of forces between the opposing sides of the attenuator, one side of the attenuator will not move up or down without the other side of the attenuator moving up or down with it. In either case, the pulleys are preferably mounted to the wall, floor or ceiling, such as by using cast in place bolt plates.

In another embodiment, a mechanical connection can be provided between the attenuator and caisson, such as vertical guides on the caisson walls wherein the attenuator can have rollers that fit into the guides, wherein the association between the rollers and guides can help keep the attenuator substantially level and stable as the water column rises and falls. In such case, the attenuator can be coupled to a roller chain, a toothed gear or belt system extending substantially vertically along the compartment, such as on opposing sides of the attenuator, wherein the coupling of the attenuator to the chain, gear, or belt system can help keep the attenuator level.

These mechanisms can help keep the attenuator substantially horizontally oriented within the compartment as it moves up and down with the water column, wherein its range of motion between opposing sides of the attenuator can be controlled, synchronized and maintained. Note that any given body of water can experience various types of motion, including six degrees of freedom, i.e., Heave (vertical, up/down motion), Yaw (rotation along the vertical axis), Sway (lateral, side-to-side motion), Pitch (rotation about its lateral axis), Surge (longitudinal front/back motion) and Roll (rotation about its longitudinal axis). In the preferred embodiments, the goal is for the water column internal to the caisson to move only in the Heave direction, i.e., vertically, up and down, and eliminate movement in the other five degrees of motion. Preferably, the attenuator is designed to limit the movement of the water column to only the Heave direction, wherein the mechanisms are used help to eliminate wave motion in the remaining five degrees, including Yaw, Sway, Pitch, Surge, and Roll.

BRIEF DESCRIPTION OF THE DRAWINGS

FIGS. 7 and 8 show formulas for determining the desired attenuator mass and thickness suitable for keeping the attenuator substantially horizontally oriented as the water column in the caisson moves up and down.

DETAILED DESCRIPTION OF THE INVENTION

Figure 1:
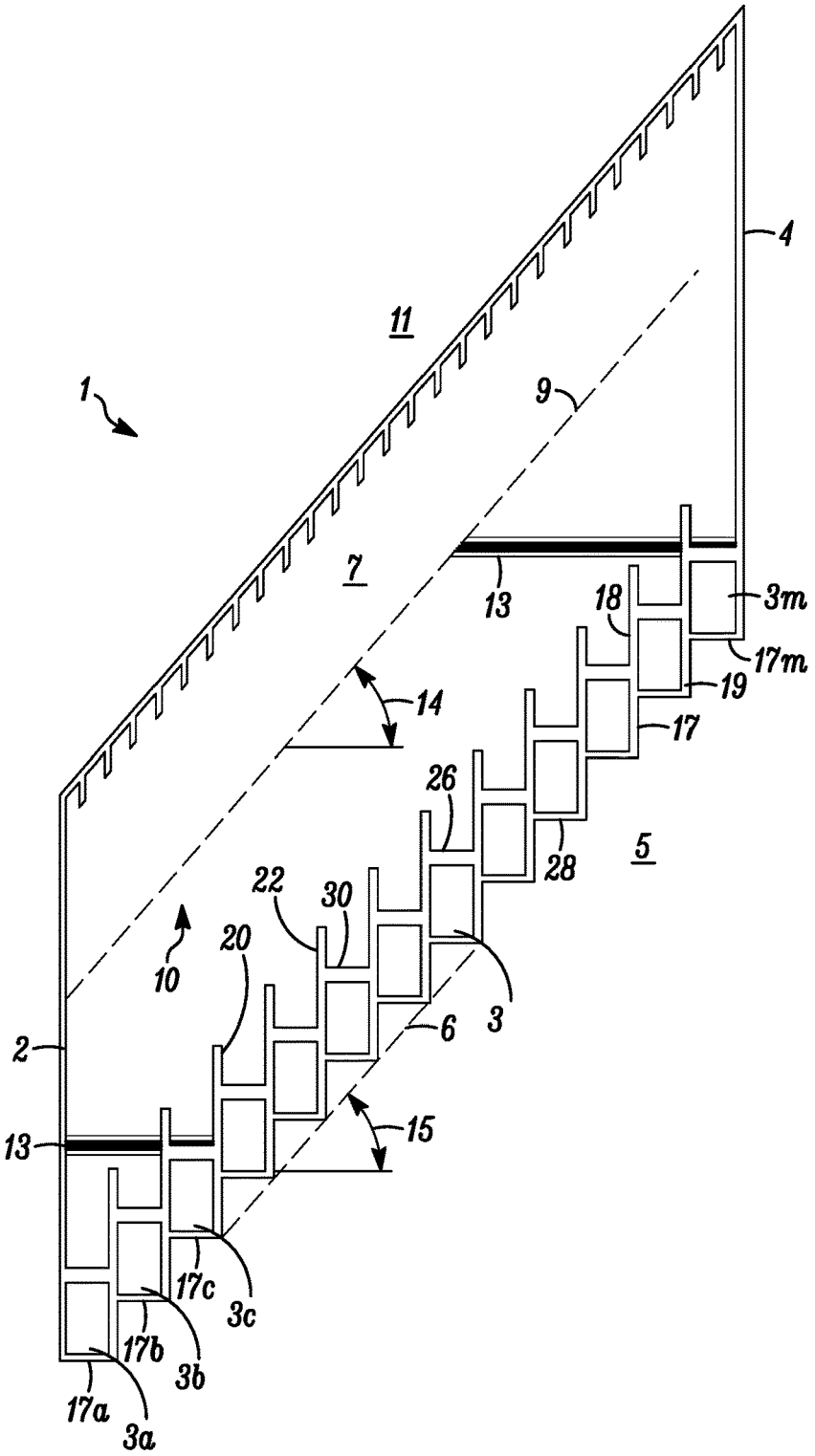
FIG. 1 is a plan view of a wave pool with a series of wave generators positioned side by side, with rectangular shaped caissons positioned side by side and staggered on the relatively deep end for producing the waves.
Figure 3:
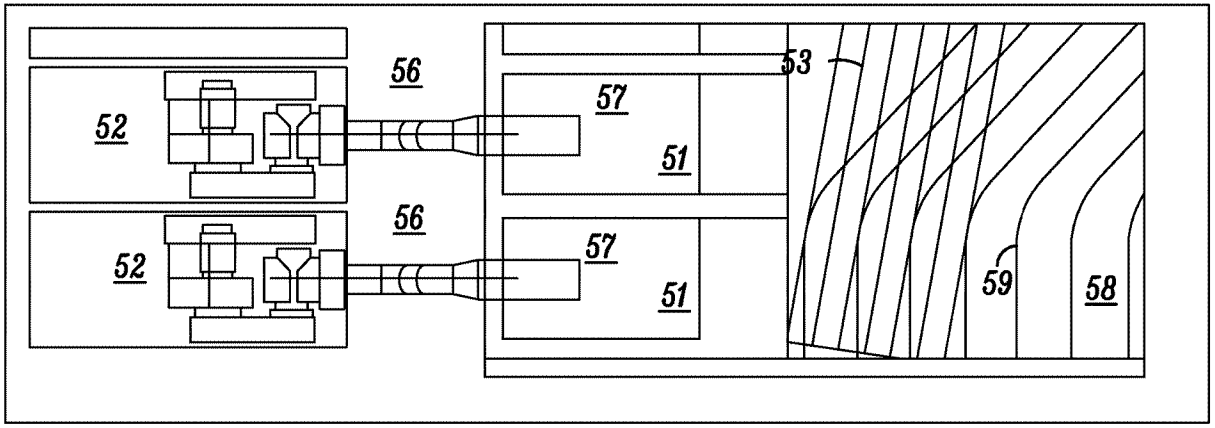
FIG. 3 is a plan view of two wave generators with caissons showing the orientation of the pump mechanisms behind the wave generators and the curvature of the sloped floor extended in front of the wave generators.

FIG. 1 is a plan view of wave pool 1 having a plurality of wave generators 3 extended along a relatively deep wave-generating end 5, along an obliquely oriented stagger line 6. A sloped shoreline 7 is preferably extended along a relatively shallow wave shoaling end 11, along a similarly oriented break line 9. In this embodiment, a series of wave generators 3 (extended along stagger line 6) are positioned side by side along one end, and a sloped shoreline 7 (extended along break line 9) is provided along the opposite end, wherein stagger line 6 and break line 9 are extended substantially parallel to each other, while at the same time, at an oblique angle relative to the down-line front or crest of waves 13 (which travel in the direction designated by arrow 10). In various embodiments, the wave generators 3 can be positioned adjacent to each other without being staggered, as shown in FIG. 3, or in any other appropriate arrangement.

In the embodiment of FIG. 1, side walls 2, 4 of wave pool 1 are preferably extended substantially parallel to each other, although not necessarily so, i.e., the outward side walls 2, 4 can be fan shaped or curved or can be provided in virtually any configuration that achieves the desired results. Wave generators 3 preferably comprise multiple caissons 17 that are positioned side by side, wherein each one is preferably staggered or offset relative to each other. For example, second wave generator 3*b*, which is housed in second caisson 17*b*, is preferably located downstream from first wave generator 3*a*, which is housed in caisson 17*a*. Likewise, third wave generator 3*c*, which is housed in third caisson 17*c*, is preferably located downstream from second wave generator 3*b*, which is housed in second caisson 17*b*, etc. Each wave generator 3 and caisson 17 in the series is preferably oriented in this fashion until the last wave generator 3*m* and caisson 17*m* in the sequence, which are preferably located further downstream than any other wave generator 3 or caisson 17 in the sequence.

The angle 15 at which stagger line 6 extends relative to the front or crest of waves 13 (or the direction that is normal to the travel direction 10 of waves 13), is referred to as the "stagger angle," which represents the angle or degree to which the wave generators 3 are offset relative to each other in the travel direction 10. And, the distance that the front wall 26 of each caisson 17 is located forward relative to the front wall 26 of each preceding caisson 17 in the series is referred to as the "stagger distance," which is the distance that each wave must travel before it reaches the front of the next succeeding caisson 17. The wave generators 3 are preferably oriented along stagger line 6 which is at an oblique angle relative to the travel direction of the resultant waves 13. They are also staggered, such that, as the wave generators are operated sequentially, one after the other, the waves that they form will eventually merge together to form a smoothly shaped resultant wave 13 suitable for surfing.

As shown in FIG. 1, each caisson 17 in plan view is preferably in the shape of a rectangular box, having a front wall 26, a pair of side walls 18, 19, and a back wall 28, and preferably, in front of each caisson 17, there is a pair of dividing walls 20, 22, extending substantially forward in wave direction 10. Preferably, dividing walls 20, 22 are extended substantially parallel to each other, like the wave generators shown in PCT/SG2011/000176, filed May 4, 2011, entitled METHOD AND APPARATUS FOR PRODUCING PROGRESSIVE WAVES SUITABLE FOR SURFING USING STAGGERED WAVE GENERATORS IN SEQUENCE, which was published on Nov. 8, 2008, as WO/2012/150908, and which is incorporated herein by reference. In alternate embodiments, they can be provided with a fade angle of no more than about 20 degrees. In either case, the dividing walls 20, 22 help to retain the energy and height of the waves formed by each wave generator 3, i.e., they can be substantially confined and maintained within the space 30 that extends in front of each wave generator 3, wherein the energy released by each wave generator 3 can be substantially retained as the waves travel forward and merge together with other waves in the series, to create the desired resultant wave 13.

The stagger angle 15 determines the angle at which the wave generators 3 are positioned relative to a direction normal to the wave direction 10. And because wave generators 3 are preferably staggered and extended at an oblique angle relative to the front or crest of waves 13, each wave generator 3 in the sequence, i.e., 3*a*, 3*b*, 3*c*, etc., is preferably operated sequentially, one after the other, to form individual waves, which can then merge together to form the resultant wave 13. As such, during operation, each wave generator 3 is preferably turned on in sequence with a predetermined time interval between each activation, wherein the time interval between each wave being formed is preferably equivalent to the time it takes one wave to travel from front wall 26 of one caisson 17 to front wall 26 of a succeeding caisson 17 in the series. For example, if it takes 1 second for a wave to travel from a front wall 26 of one caisson 17*b* to a front wall 26 of the next succeeding caisson 17*c*, i.e., this distance is referred to as the "stagger distance," then the preferred time interval between successive activations should also be 1 second. This helps to ensure that each wave formed by each wave generator 3 will merge at the appropriate time, and in the appropriate manner, to form a substantially smooth resultant wave 13 that travels downstream across wave pool 1 in wave direction 10. Then, as the resultant waves 13 are formed by wave generators 3 within pool 1 and approach shoreline 7 in the direction of arrow 10, and pass over break line 9, they will begin to break and peel laterally, wherein the momentum of the waves will cause them to break forward across the width of wave pool 1, progressively from one side of the pool to the other, i.e., from side wall 2 to side wall 4.

As for the timing and frequency of the resultant waves 13, they can be determined by the time interval that elapses between each successive sequence or cycle of wave generator activations. That is, after the first wave generator is activated, followed by each successive wave generator 3 in the sequence, the cycle can repeat itself by initiating the reactivation of the first wave generator 3 in the series, followed by the reactivation of each successive wave generator in the sequence, etc. In this respect, a time interval of 6 seconds to 90 seconds, or more or less, for each cycle is contemplated, which allows sufficient time for each wave generator to charge up before discharging, and before the next cycle begins.

Figure 2:
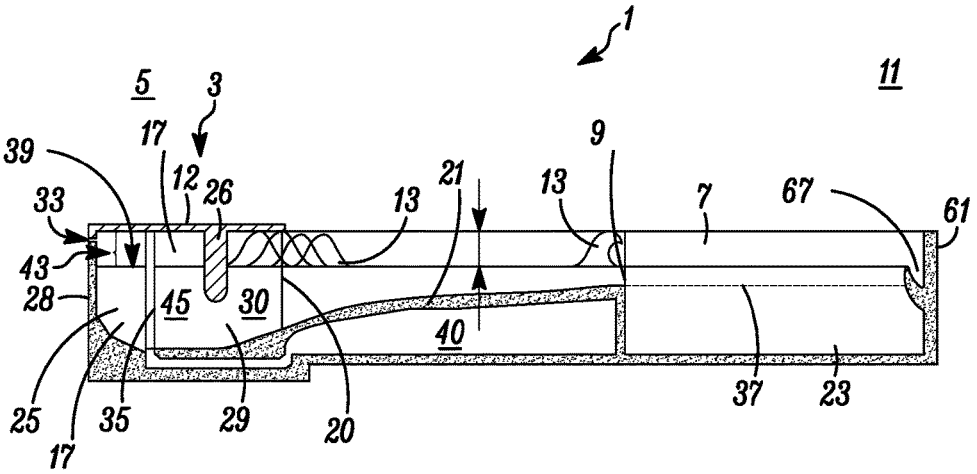
FIG. 2 is a section view of the wave pool shown in FIG. 1, showing a wave generator with a caisson on the left hand side, which has a floating attenuator with a central post extended therein, along with a sloped pool floor extending toward the shallow end, with an air tank positioned below it, and a wave dampening chamber located on the right hand side.

FIG. 2 shows the general cross sectional configuration of wave pool 1 wherein wave generators 3 are shown extended along relatively deep wave-generating end 5 on the left hand side and shoreline 7 is shown along relatively shallow wave shoaling end 11 on the right hand side. Extended between wave-generating end 5 and wave shoaling end 11 is preferably a sloped floor 21 that extends along the shoaling section followed downstream by break line 9, wherein sloped shoreline 7 preferably comprises a wave dampening chamber 23 having a perforated raised floor 37, like the one shown in Applicant's U.S. Pat. No. 8,561,221, issued on Oct. 22, 2013, which is incorporated herein by reference, which helps to dampen the waves and reduce unwanted rip currents and reflections that can otherwise negatively affect the formation and breaking of additional subsequent oncoming waves.

This view generally shows resultant waves 13 emanating from wave generators 3 traveling substantially from wave-generating end 5 to wave shoaling end 11, i.e., from left to right. The slope of floor 21 at the wave breaking zone is preferably between 2% and 12% (depending on the preferable Iribarren number in the wave breaking zone). For each wave generator 3, the minimum distance extending from front wall 26 to breaker line 9 (shoaling area or reef) and from breaker line 9 to end wall 61 (dampening area) is preferably wave size (height/amplitude) dependent. Due to the bathymetry (variable slopes) of floor 21, each wave 13 preferably begins to break forward at the appropriate depth, such as along break line 9, wherein the waves preferably break forward toward shallow end 11. Wave pool 1 can be constructed using conventional materials such as concrete with reinforcing bars, etc.

Each wave generator 3 preferably comprises one caisson 17, which comprises a watertight column or compartment 25 capable of being filled with air and water. Preferably, each caisson 17 has a top wall or ceiling 12, side walls 18, 19 (shown in FIG. 1), back wall 28, and partial front wall 26, wherein below front wall 26 is preferably an opening 29 having a predetermined height and size which allows water and wave energy to pass forward and into pool 1. While other types of wave generators, such as those that are mechanically or hydraulically operated, can be used and are contemplated by the present invention, the preferred wave generator is pneumatically operated.

Figure 9:
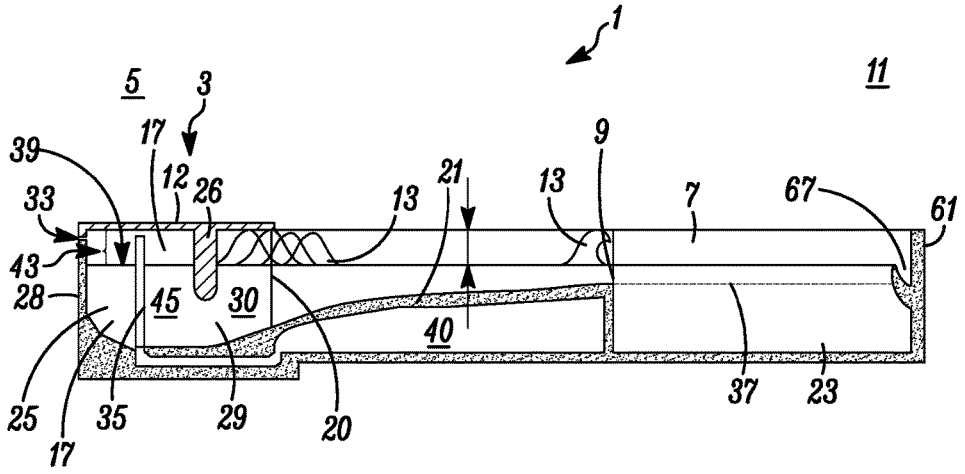
FIG. 9 shows an embodiment similar to the one shown in FIG. 2 except the post ends short of the ceiling.

In the embodiment of FIG. 2, each caisson 17 preferably has a substantially vertically oriented post 35 that can be extended upward within the middle of compartment 25, and which preferably extends to top wall 12, although not necessarily so. Post 35 preferably comprises a hollow tube 35 that can be used to introduce air from storage tank 40 into and out of compartment 25 at the appropriate time. In such case, post or tube 35 is preferably extended from tank 40 and up through the floor of the caisson 17, wherein an opening at the top end of tube 35 can be provided to enable air to be introduced into and out of caisson 17. In one embodiment, post or tube 35 can be extended all the way up to top wall 12, and connected thereto, wherein openings (through which air can pass) can be located on the sides of post 35 near the top. In another embodiment, as shown in FIG. 9, post or tube 35 can be extended up to near the top of caisson, wherein a gap can be provided between the top end of post 35 and caisson ceiling 12, such that air inside tube 35 can travel through the gap and into and out of caisson 17.

In the preferred embodiments, a floating attenuator 39 is preferably provided within compartment 25 which can float up and down within caisson 17 on top of water column 45. Attenuator 39 preferably comprises a relatively thick and heavy sheet or block of durable, rigid and buoyant material, i.e., less dense than water, so that it floats on top of the water surface. In one embodiment, attenuator 39 is preferably made using large diameter pipes (perhaps 16" or so in diameter) that are capped and positioned side by side and connected together to form a rectangular "deck," wherein the pipes can be made from durable material, such as PVC, plastic, aluminum or other rust proof material. In another embodiment, attenuator 39 is preferably a fabricated or molded buoyant rigid foam sheet of material, such as one shaped in the configuration of the caisson, wherein the foam material can be bonded to a rust-proof metal frame or other heavy structure to provide extra strength, rigidity and mass to the structure.

In either case, attenuator 39 preferably has sufficient density, mass and weight to hold a steady position internal to the caisson to counteract the varied surface wave actions and water movements that can occur within the compartment, wherein the configuration and construction of the attenuator is preferably sufficiently thick and heavy enough such that it compensates for the varied upward and side pressures that can otherwise cause surface chops, surges and standing waves to form on the water surface. In this respect, if the attenuator is designed too light, when water movements occur, the attenuator could easily be lifted up and above the internal caisson wave crests, wherein associated wave troughs can be produced, wherein the water surface in the caisson would not be kept horizontal and flat and therefore the function of the attenuator would be compromised. Although buoyant, attenuator 39 is preferably sufficiently thick, dense and heavy enough such that it remains partially submerged within the water to properly remove the referenced chops/surges/standing waves, while simultaneously minimizing water splashing over the top of the attenuator.

The attenuator 39 is preferably designed to minimize internal caisson wave action by maintaining a substantially horizontal or flat orientation within the caisson during wave generation, i.e., preferably no air gaps below the attenuator due to floating on wave crests, and no wave action over the top of attenuator. One way to achieve the desired results is to design attenuator 39 with a predetermined mass and thickness based on the following formulas (which relate to the design parameters shown in FIGS. 7 and 8, which also include a reproduction of these formulas):

$$A=a*h*(1-z/H-\tfrac{1}{2}*h/H)$$

$$F+=\rho*g*A*b=\rho*g*a*h*(1-z/H-\tfrac{1}{2}*h/H)*b$$

$$F-=M*g=\bar{\rho}*a*b*h*g$$

$$F+=F-$$

$$\ldots\ \rho*g*a*b*h*(1-z/H-\tfrac{1}{2}*h/H)=\bar{\rho}*a*b*h*g$$

$$\ldots\ \rho*(1-z/H-\tfrac{1}{2}*h/H)=\bar{\rho}$$

At rest (as shown in FIG. 8):

$$Mg=a*b*x*\rho*g\text{»}p\bar{}*h=\rho*x \text{ or } \bar{\rho}=\rho*x/h$$

$$\ldots\ (1-z/H-\tfrac{1}{2}*h/H)=x/h$$

For $z=0$ and $x/h=\tfrac{2}{3}$»$1-z/H-x/h=\tfrac{1}{2}*h/H$ $$\ldots\ 2H*(1-z/H-x/h)=h\text{»}h=\tfrac{2}{3}H$$

where the following are the definitions:

a=length (front wall to back wall of caisson, equals ~length of attenuator)

b=width (inside width of caisson, equals ~width of attenuator)

h=thickness (thickness of attenuator)

H=assumed wave height (node in middle)

z=air gap under bottom of attenuator at random distance from trough of standing wave in caisson (goal is z=0, i.e., no air gap).

g=acceleration due to gravity

ρ=density of water (Greek letter "rho")

$\bar{\rho}$=average density of attenuator (mass of attenuator divided by the volume of the attenuator)

A=wet area of attenuator

F+=upward force equals amount of submersed volume of attenuator=amount of displaced water (the law of Archimedes!;-)

F−=downward force (weight) equals mass of attenuator (M)×gravity

M=mass of attenuator x=amount of attenuator below still water level (in still water).

Preferably, attenuator 39 has a hole 87 in the center through which post or tube 35 can be extended so that attenuator 39 can travel up and down along post or tube 35 within compartment 25, wherein the association between post or tube 35 and hole 87 can help keep attenuator 39 substantially stable, such that it stays in a substantially horizontal orientation as it travels up and down. In this respect, the relative thickness of attenuator 39 and the height of hole or opening 87 is preferably at least four times the gap that extends between post or tube 35 and the inside wall of hole 87. That way, in the event due to wave action the attenuator 39 begins to tip or tilt, the alignment of the hole 87 in relation to post or tube 35 will limit the tipping/tilting as attenuator 39 moves up and down within caisson 17. Note: In order to reduce friction, roller bearings or a silicon sliding surface or similar friction minimizing material or mechanism can be added along points of interface between post or tube 35 and hole 87.

Preferably, the caisson compartment 25 extends well above the standing mean surface elevation of the body of water in the wave pool, such that a substantial pressure head is created when compartment 25 is filled with water, which can facilitate the downward momentum of the water column down and forward through caisson opening 29, i.e., during the discharge phase. The weight of attenuator 39 can also help facilitate this movement.

The air introduced into and out of compartment 25 can be stored within a chamber, plenum or tank 40, such as shown under floor 21 in FIG. 2. During the charging phase, air is preferably drawn out of compartment 25, through the top of tube 35, and into tank 40, using a fan, blower or pump (not shown), which can cause the water level within caisson 17 to rise (as the back pressure within compartment 25 causes water to be drawn from pool 1 and into compartment 25 through caisson opening 29). The pump can comprise a vacuum and/or pressure plenum, or those that use only a vacuum fan without a plenum and no active pressure side, or versions that use both a vacuum fan and pressure fan with no plenum, or those that use only a pressure fan, etc. In such case, the air drawn out is preferably compressed into the tank 40, where the compressed air can be stored until it is ready to be released during the discharge phase. Then, at the appropriate time, i.e., when wave generator 3 is ready to be activated, the compressed air within tank 40 can be released and/or pumped back through tube 35 and into compartment 25, which causes the water column 45 underneath it, along with attenuator 39, to drop rapidly, which forces the water column within compartment 25 down and forward through caisson opening 29, thereby forming wave movements within wave pool 1.

Attenuator 39 preferably helps to keep the forces within compartment 25 relatively constant across the water column 45, such that a consistent amount of water is forced down at a desired velocity and through caisson opening 29, thus allowing for a more uniform emission of water and wave energy into the pool.

A separate valve or opening 33 can be provided in compartment 25, which allows air to escape when necessary, wherein, if the pressure head within compartment 25 is high enough, simply allowing air to be introduced into compartment 25, with or without releasing air within tank 40, may allow the water column 45 to drop during the discharge phase, such as by gravity alone, to cause water to be forced forward through caisson opening 29 and into wave pool 1. During the charging phase, because the cavity inside compartment 25 is substantially airtight, when air within compartment 25 is drawn out through tube 35, the water level within compartment 25 naturally rises, wherein due to back pressure, water is drawn in from wave pool 1, i.e., through caisson opening 29, and into compartment 25. At this point, the caisson freeboard 43, which is the vertical distance between the top of the attenuator 39 and top wall or ceiling 12, as shown in FIG. 2, within compartment 25, can be reduced or substantially eliminated, i.e., virtually all air within compartment 25 can be sucked out. By withdrawing air from the top of compartment 25, the water level within compartment 25 can rise until such time that compartment 25 is substantially filled with water, which increases the depth of water column 45 within compartment 25 and the pressure head thereof. And by raising the water level within compartment 25, and increasing the pressure head, water in caisson 17 can be forced down and through caisson opening 29 to create wave movements in wave pool 1, which, as discussed, can be done by gravity alone, or by releasing the compressed air from tank 40 into compartment 25, or by using an ancillary fan, blower or pump, which provides additional momentum and energy transfer to create larger waves. Thus, forcing water down and forward through caisson opening 29 creates a wave directly in front of front wall 26, wherein back wall 28 can be provided with a rounded corner to facilitate the movement of water forward through caisson opening 29.

Preferably, because dividing walls 20, 22 are extended substantially parallel to each other and forward in front of each wave generator 3, the energy of the waves formed by each wave generator is substantially confined and maintained in substantial equilibrium in front of each wave generator 3, i.e., between each pair of dividing walls 20, 22, before they merge together with other waves in the series. As such, the wave energy released by each wave generator 3 is substantially retained as the waves travel forward through space 30, which helps preserve the amplitude and shape of the progressing waves, prior to merging together with other waves in the series to form the resultant wave 13. Then, as the waves merge together to form the resultant wave 13, and as resultant wave 13 travels forward through pool 1, the slope of floor 21 helps to cause resultant wave 13 to begin breaking, such as along break line 9, as shown in FIG. 2.

Wave dampening area 23 is preferably extended between break line 9 and far wall 61 of pool 1 along shoreline 7 and preferably comprises a perforated false floor 37 extended over a bottom floor, which helps facilitate the dissipation of wave energy and thereby reduces the energy of the waves, as well as the rip currents and reverse flows that can otherwise occur along shoreline 7. A gutter 67, such as shown in FIG. 2, can be provided along back wall 61.

FIG. 3 is a plan view showing multiple wave generators 51 positioned side by side in a straight line (without a stagger) comprising a fan, blower or pump mechanism 52 for injecting air into and out of caisson 57, wherein mechanism 52 is preferably positioned behind caisson 57, and a duct 56 is preferably extended between mechanism 52 and caisson 57 to allow communication between them. As can be seen, each caisson 57 is preferably in the shape of a rectangular box from above, wherein caissons 57 are positioned side by side adjacent to one another, either with or without a stagger or offset, wherein wave generators 51 are preferably activated and operated in a manner that produces resultant waves 53 travelling forward toward shoreline 58. The slope of shoreline 58 is represented by multiple depth contours 59.

Wave generators 51 can be activated sequentially, one after the other, with a predetermined time interval between activations, such that the individual waves they create travel forward and merge together to create a single resultant wave 13 that travels at an oblique angle relative to shoreline 58. The greater the time interval that exists between activations, the greater the angle at which resultant wave 53 will travel obliquely relative to shoreline 58. On the other hand, without any stagger, if wave generators 51 are activated at the same time, a single resultant wave will be generated at once, which will travel forward in unison, i.e., in a direction that is substantially forward in front of each wave generator 51, wherein the wave crest of each wave 53 will be oriented substantially parallel to wave generators 51.

Figure 4:
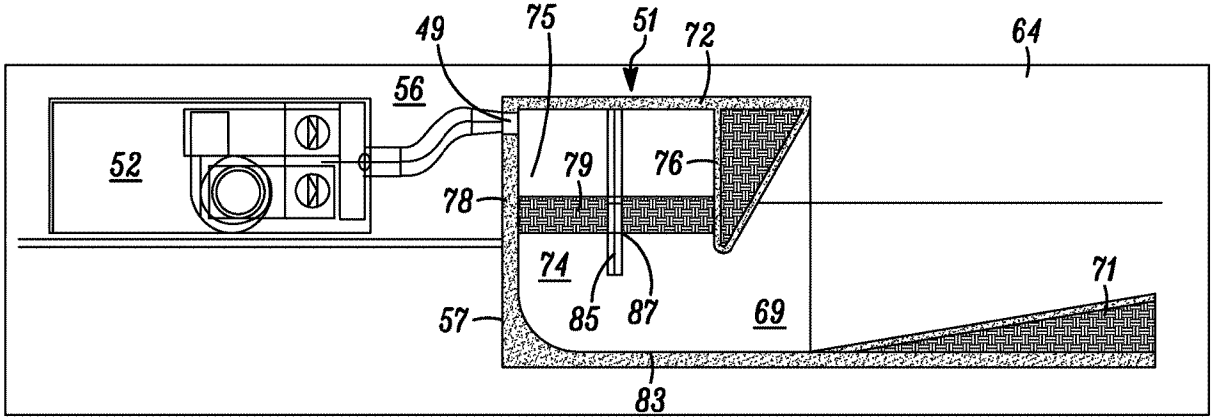
FIG. 4 is a detailed section view of an embodiment of a wave generator with a floating attenuator extended within the caisson, along with a central post extended down within the compartment, wherein a pump mechanism is provided behind the caisson which can be used to enable air to be introduced into and out of the caisson to produce the waves.

FIG. 4 is a section view of wave pool 64 and wave generator 51, with fan, blower or pump mechanism 52 for injecting air into and out of caisson 57 positioned behind caisson 57, wherein part of sloped floor 71 is shown on the right hand side. Duct 56 is preferably extended between pump mechanism 52 and caisson 57 such that mechanism 52 communicates with caisson 57, via duct 56, and through opening 49, wherein during the charging phase, pump mechanism 52 is capable of drawing air out of caisson 57 and causing water to be drawn from pool 64 and into caisson 57 through caisson opening 69. Then, during the discharge phase, pump mechanism 52 is preferably capable of allowing air to be introduced back into caisson 57, via duct 56, which causes water column 74 to drop down and forward through caisson opening 69 and into wave pool 64 to create the waves.

As shown in FIG. 4, caisson 57 preferably comprises a watertight column or compartment 75 capable of being filled with air and water, and preferably, each caisson 57 has a top wall or ceiling 72, side walls (such as 18 and 19 shown in FIG. 1), back wall 78, floor 83, and partial front wall 76, wherein below front wall 76 is preferably a caisson opening 69 having a predetermined height and size which allows water and wave energy to pass forward into wave pool 64. Each caisson 57 can be made of reinforced concrete or other structural material.

Preferably, an attenuator 79 is provided within compartment 75 that floats on top of the water surface, and in this embodiment, like the embodiment of FIG. 2, each caisson 57 preferably has a substantially vertically oriented post or tube 85, but unlike the embodiment of FIG. 2, post or tube 85 is not used to inject air into and out of caisson 57, but rather, it is simply a post used to guide attenuator 79 up and down as it floats on top of water column 74. In such case, attenuator 79 preferably has a hole or opening 87 in the center through which post or tube 85 can be extended so that it can travel up and down along post or tube 85, wherein attenuator 79 is coupled with post or tube 85 to help keep it substantially horizontal as it travels up and down within compartment 75. In this respect, attenuator 79 is preferably made of a relatively thick and substantially durable, rigid and buoyant material or sheet, wherein the relative height of hole 87 in the center of attenuator 79 is preferably at least four times the gap that extends between post or tube 85 and hole 87, wherein the combination of the two preferably helps to keep attenuator 79 substantially horizontal.

Hole 87 is preferably comprised of an inner sleeve made of a durable rigid material, such as stainless steel, that will retain its shape and resist bending, such that the relative movement of post or tube 85 within hole 87 will keep attenuator 79 substantially horizontally oriented. In the event due to wave action attenuator 79 begins to tip, the alignment of the inner sleeve relative to post or tube 85 will preferably limit the tipping motion, i.e., it will be limited by the narrow gap between post or tube 85 and inner sleeve of hole 87. In order to reduce friction, roller bearings or a slick Teflon sliding surface or similar friction minimizing material or mechanism can be used on the points of interface between hole 87 and post or tube 85.

In the preferred embodiment, only one post or tube 85 is used, but in alternate embodiments, more than one post or tube 35 can be used, wherein the associated holes on attenuator 79 are preferably arranged symmetrically about a centerline of attenuator 79, such that there is an even distribution of energy applied against attenuator 79 as it moves up and down within caisson 57. In this embodiment, post or tube 85 does not have to be hollow and can be made of any durable material, such as concrete, plastic, stainless steel, aluminum, fiberglass, etc., that is rust free, and connected to top wall 72 of caisson 57 and/or floor 83 using conventional means such as cast in place bolt plates.

Preferably, caisson compartment 75 extends well above the standing mean surface elevation of the body of water in wave pool 1, such that a significant pressure head is created when compartment 75 is substantially filled with water, which can facilitate the downward momentum of water down and forward through caisson opening 69 during the discharge phase. The weight of attenuator 79 can also help facilitate this movement. In this respect, pump mechanism 52 simply needs to draw air out of compartment 75 during the charging phase to draw water into caisson 57 through lower caisson opening 69, and during the discharge phase, air simply needs to be allowed to enter back into compartment 75, such as through duct 56, wherein the pressure head and weight of water column 74 in compartment 75 along with the weight of attenuator 79 can cause water column 74 to drop down within compartment 75, wherein water will then be forced down and forward through caisson opening 69 and into wave pool 64. Thus, with a sufficient pressure head, no fan, blower or pump is necessarily needed to introduce air into compartment 75 during the discharge phase, although a fan, blower or pump can be used to accelerate movement of water, if desired. As with the previous embodiment, attenuator 79 preferably eliminates wave action on the surface of water column 74, and thereby keeps the forces applied against it relatively constant across compartment 75, such that a consistent amount of water can be emitted at a substantially constant velocity across the width of compartment 75, thus allowing for a more uniform emission of water and wave energy from caisson 57 into pool 64.

During this critical step, the attenuator preferably floats on top of the water column and by virtue of its weight and thickness it is preferably partially submerged and keeps the water surface relatively flat, thereby avoiding extraneous wave action, which helps to keep the desired primary wave motion relatively stable and constant as the water is emitted into the wave pool. And, by virtue of the mechanisms and other aspects discussed herein, the attenuator preferably remains stable in a substantially horizontal position, which further helps to keep the water and wave action on the surface of the water column stable and consistent from one wave to the next.

Figure 5:
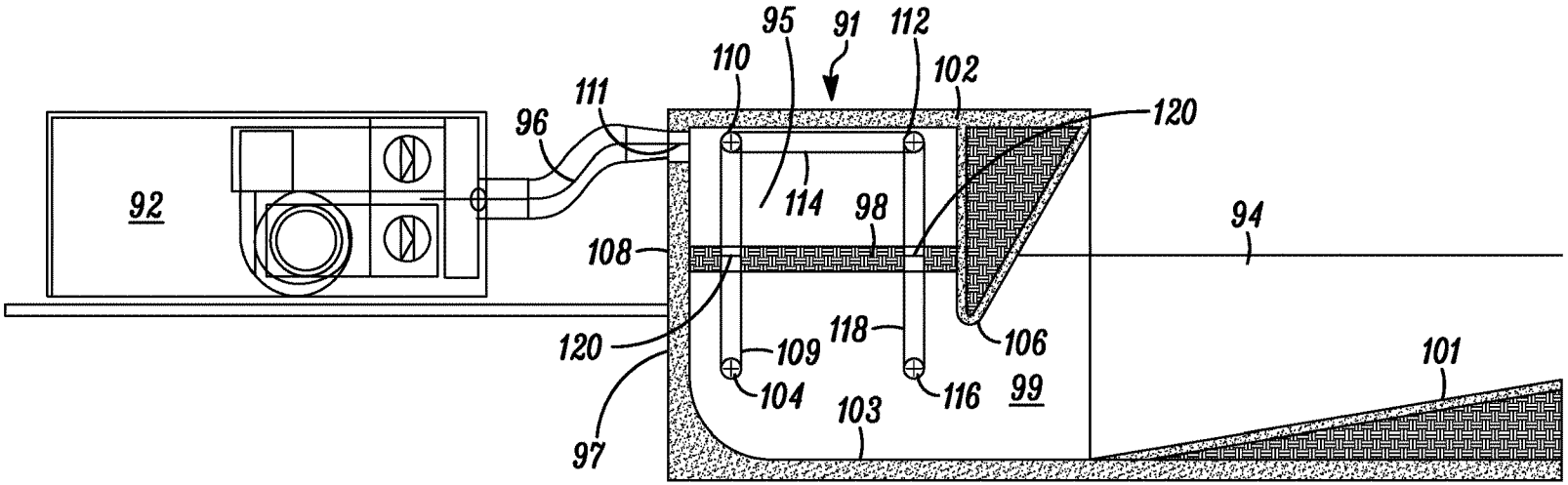
FIG. 5 is a detailed section view of an embodiment of a wave generator with a floating attenuator extended within the caisson, along with a multiple cable and pulley system, wherein several pulleys are provided on the caisson walls and several cables are extended within the pulleys, wherein two of the cables are secured to opposing sides of the attenuator to keep the attenuator substantially horizontally oriented.

FIG. 5 is a section view of wave pool 94 showing alternate wave generator 91, with fan, blower or pump mechanism 92 for injecting air into and out of caisson 97 positioned behind caisson 97, wherein part of sloped floor 101 is shown on the right hand side. Duct 96 is preferably extended between mechanism 92 and caisson 97 such that mechanism 92 communicates with caisson 97, via duct 96, and through opening 111, wherein during the charging phase, pump mechanism 92 is preferably capable of drawing air out of caisson 97, which draws water from wave pool 94 and into caisson 97 through caisson opening 99. And during the discharge phase, pump mechanism 92 is preferably capable of allowing air to be introduced back into caisson 97, via duct 96, which causes water in caisson 97 to drop down and forward through caisson opening 99 and into pool 94 to create the desired waves.

As shown in FIG. 5, caisson 97 preferably comprises a watertight column or compartment 95 capable of being filled with air and water, and preferably, each caisson 97 has a top wall or ceiling 102, side walls (such as 18 and 19 shown in FIG. 1), back wall 108, floor 103, and partial front wall 106, wherein below front wall 106 is preferably a caisson opening 99 having a predetermined height and size which allows water and wave energy to pass forward into wave pool 94. Each caisson 97 can be made of reinforced concrete or other structural material. Preferably, an attenuator 98 is provided in compartment 95 that floats on top of the water surface, and in this embodiment, unlike previous embodiments, each caisson 97 preferably has a multiple cable and pulley system to help keep attenuator 98 in a substantially horizontal position as it moves up and down within compartment 95. The cable and pulley system preferably includes a first and second pulley 104, 110, with first cable loop 109 extended between them, second and third pulleys, 110, 112, with second cable loop 114 extended between them, and third and fourth pulleys 112, 116, with third cable loop 118 extended between them. Each pulley 104, 110, 112 and 116 is preferably secured to the caisson walls and adapted to rotate along a horizontal axis, wherein cable loops 109, 114 and 118 are preferably coupled to the pulleys such that all three cables 109, 114 and 118 move in unison, i.e., when one cable moves a certain distance, up or down or sideways, the other cables will also move up or down or sideways the same distance. And because cable loops 109 and 118 are separately attached to opposing sides of attenuator 98, when one side of attenuator 97 moves up or down, the cables under tension will act as a constraint, such that the opposite side of attenuator 98 will move up or down the same distance, wherein attenuator 98 can be maintained in a substantially horizontally oriented position as the attenuator moves up and down. Note: To ensure that attenuator 98 is retained in a substantially horizontal position in each direction, two or more cable and pulley systems, similar to the one described above, can be provided on different sides, i.e., one cable and pulley system can be provided on one side and another cable and pulley system can be provided on the other side, an equidistance away from the centerline of the attenuator.

Attenuator 98 preferably has holes 120 through which cable loops 109 and 118 can pass, wherein although cable loops 109 and 118 are secured to attenuator 98, because the cable loops must be allowed to rotate about the pulleys, those cable loops 109 and 118 must also be allowed to pass through attenuator 98. That way, when attenuator 98 moves up or down, and the attached portions of cable loops 109 and 118 move with it, the opposite sides of cable loops 109 and 118 can move in the opposite direction, without affecting the movement of attenuator 98. For example, when water begins to fill compartment 95, and attenuator 98 begins to rise, the attached portion of cable loops 109 and 118 will move up with it, but because they are coupled between pulleys 104 and 110, and 112 and 116, respectively, and cable loops 109 and 118 must be allowed to rotate about those pulleys, they will also need to move in the opposite direction, i.e., an equal but opposite distance, through holes 120.

In an alternate version, cable loops 109, 114 and 118 can be replaced by a roller chain or toothed gear system, such that attenuator 98 travels up and down along the chain or gear system. In such case, each pulley can be provided with associated sprockets or teeth that guide the roller chain or gear system up and down to synchronize the movement of opposing sides of attenuator 98. Alternatively, a similar toothed gear system can be extended substantially vertically along the side walls, such as one on each side, wherein associated toothed gear sprockets can be provided on the attenuator 98, wherein the association between the toothed gears on attenuator 98 and those on the side walls can keep attenuator 98 substantially horizontal.

Figure 6:
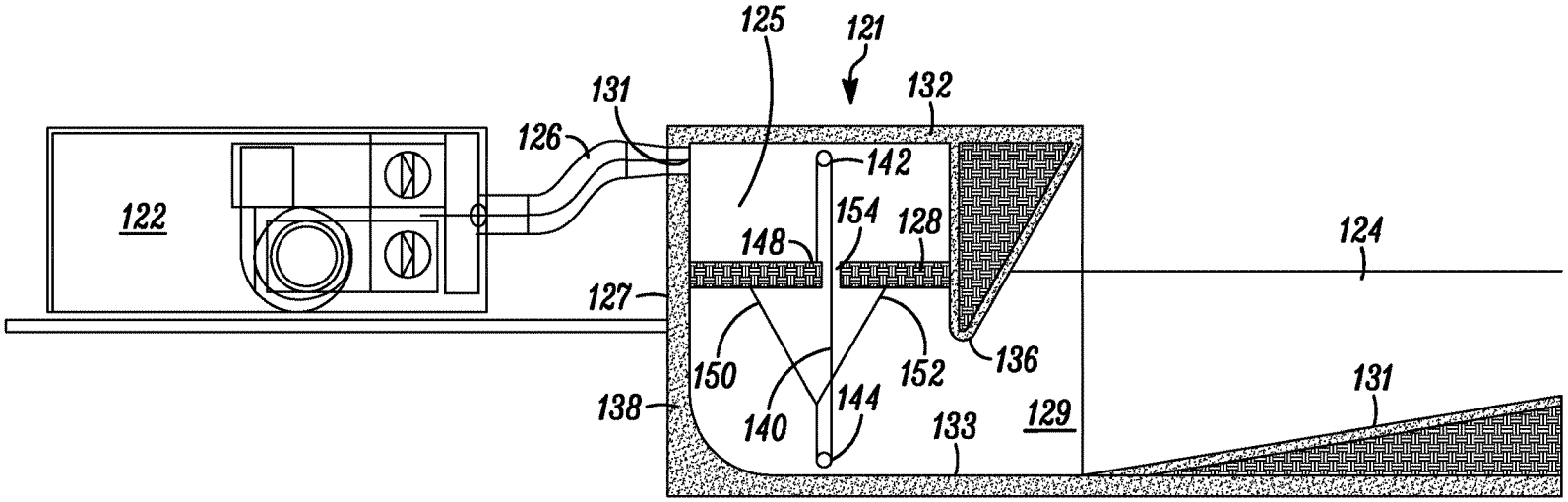
FIG. 6 is a detailed section view of an embodiment of a wave generator with a floating attenuator extended within the caisson, along with a single cable and pulley system, wherein one end of the cable is secured to the top of the attenuator, and the lower end of the cable is secured to opposing sides of the attenuator, wherein the even distribution of force between the opposing sides help to keep the attenuator substantially horizontally oriented as the water column moves up and down.

FIG. 6 is a section view of wave pool 124 showing alternate wave generator 121, with fan, blower or pump mechanism 122 for injecting air into and out of caisson 127 positioned behind caisson 127, wherein part of sloped floor 131 is shown on the right hand side. Duct 126 is preferably extended between mechanism 122 and caisson 127 such that mechanism 122 communicates with caisson 127, via duct 126, and through opening 131, wherein during the charging phase, mechanism 122 is capable of drawing air out of caisson 127, which in turn, draws water from pool 124 and into caisson 127 through caisson opening 129. Conversely, during the discharge phase, mechanism 122 is preferably capable of injecting or allowing air to be introduced into caisson 127, via duct 126, which forces water in caisson 127 to drop down through caisson opening 129 and into pool 124 to create the waves.

Caisson 127 preferably comprises a watertight column or compartment 125 capable of being filled with air and water, and preferably, each caisson 127 has a top wall or ceiling 132, side walls (such as 18 and 19 shown in FIG. 1), back wall 138, floor 133, and partial front wall 136, wherein below front wall 136 is preferably a caisson opening 129 having a predetermined height and size which allows water and wave energy to pass forward into pool 124. Each caisson 127 can be made of reinforced concrete or other strong structural material.

Preferably, an attenuator 128 is provided in caisson 127 which floats on top of the water surface, and in this embodiment, unlike previous embodiments, each caisson 127 preferably has a single cable and pulley system that helps keep attenuator 128 substantially horizontally oriented as it moves up and down within compartment 125. This cable and pulley system preferably includes first and second pulleys 142, 144, one near the top of caisson 127 and one near the bottom, with a cable 140 extended between them, wherein one end 148 of cable 140 is connected to the upper surface of attenuator 128, and the opposite end has two branch cables, 150, 152, which are connected to opposing sides of attenuator 128, wherein branch cables 150, 152 are preferably held substantially equidistant apart from each other relative to cable 140 and symmetrically arranged relative to attenuator 128, such that, as attenuator 128 moves up and down, and cable 140 is pulled tight between pulleys 142, 144, each branch cable 150, 152 applies an equal tension or force to hold attenuator 128 in a substantially horizontally oriented position. Because cable 140 preferably remains taught, branch cables 150, 152 also preferably remain taught, sufficient to keep attenuator 128 substantially horizontally oriented as it moves up and down in compartment 125.

Like the previous embodiment, each pulley 142, 144 is preferably secured to the caisson walls and adapted to rotate along a horizontal axis, and cable 140 is preferably allowed to rotate about the pulleys, either clockwise or counter clockwise. Therefore, when one end 148 of cable 140 moves a certain distance up or down, the other end of cable 140 moves the same distance down or up, i.e., in the opposite direction. And because the opposing branch cables 150, 152 of cable 140 are attached to opposing sides of attenuator 128, and branch cables 150, 152 are attached to attenuator 128 an equidistant apart from the centerline of cable 140 and symmetrically arranged relative to attenuator 128, when attenuator 128 moves up or down, both sides of attenuator 128 will travel the same distance up or down, which helps keep attenuator 128 level.

Note: Although two branch cables 150, 152 are provided, it can be seen that more than two branches can be used to keep attenuator 128 substantially horizontal. To ensure that attenuator 128 is retained in a substantially horizontal position in each direction, additional branch cables, similar to the ones described above, can be provided, although in such case, each branch cable must be connected to attenuator at locations that are equidistant from the centerline of cable 140 and symmetrically arranged relative to attenuator 128.

Attenuator 128 preferably has a hole 154 in the center through which cable 140 can pass, wherein cable 140 is allowed to pass through attenuator 128 to operate. That is, as attenuator 128 moves up or down, and as cable 140 moves with it, the connected ends of cable 140 will move along with attenuator 128, but as cable 140 loops around pulleys 142, 144, they must also pass through hole 154 to enable attenuator 128 to move freely. For example, when water is introduced into compartment 125, and attenuator 128 begins to rise, the cable 140 connected to attenuator 128 will move upward with it, but cable 140 will also have to loop around the pulleys and move in the opposite direction, i.e., down, relative to attenuator 128, wherein cable 140 will have to pass through hole 154 without affecting the movement of attenuator 128.

In an alternate embodiment, cable 140 can be replaced by a roller chain or toothed gear system, wherein the pulleys can be replaced by associated sprockets or teeth that can guide the roller chain or gear system up and down, which can, along with the branch cables, keep attenuator 128 substantially horizontal as it moves up and down within compartment 125.

Note that it is possible to use an encoder and spool counter or other device to monitor the position of the floating attenuator within the compartment. Indeed, in order to ensure the attenuator is working properly, it may be desirable to monitor its position with infrared, acoustic, optical or laser distance sensors. The stability and horizontal position of the attenuator may also be measured and monitored using any combination of a digital inclinometers, array of optical sensors and/or heave sensors.

What is claimed is:

1. A wave generator for a wave pool comprising:

a caisson associated with a body of water within said wave pool, wherein a column of water within said caisson communicates with said body of water;

a fan, blower or pump mechanism which introduces air into and out of said caisson and has the effect of causing said column of water to move up and down within said caisson;

a floating attenuator positioned on top of said column of water, wherein said attenuator is adapted to remain substantially in contact with the surface of said column of water as it moves up and down within said caisson; and a substantially vertically oriented post positioned inside said caisson which is extended through a hole in said attenuator, wherein the movable association between said hole and said post helps to keep said attenuator in a substantially horizontal orientation as it travels up and down within said caisson.

2. The wave generator of claim 1, wherein said attenuator has a predetermined thickness, and said hole within said attenuator has a predetermined height, wherein a gap that extends between said post and said hole is less than one-fourth the distance of said height.

3. The wave generator of claim 1, wherein an opening is provided at or near a top of said caisson through which air can be introduced into and out of said caisson by said mechanism, wherein said caisson is extended substantially above a standing mean surface elevation of said body of water, and said post is connected to a ceiling of said caisson and extends down therefrom.

4. The wave generator of claim 1, wherein said post is a hollow tube that communicates with said mechanism, wherein said tube is adapted with an opening at or near its top end to allow air to be introduced into and out of said caisson by said mechanism.

5. The wave generator of claim 4, wherein said tube has a bottom end connected to a floor of said caisson, and wherein said top end of said post ends short of a ceiling of said caisson, wherein said opening is formed by a gap extending between said top end of said post and said ceiling of said caisson.

6. The wave generator of claim 4, wherein said top end of said post is connected to a ceiling of said caisson, wherein said opening is provided on a wall of said post just below said ceiling.

7. The wave generator of claim 4, wherein said wave pool has a sloped floor under which there is a storage tank for storing air, wherein said mechanism is adapted to cause air in said tank to be introduced into and out of said caisson through said tube.

8. The wave generator of claim 1, wherein said attenuator is buoyant and has sufficient mass, density and weight to enable a bottom surface of said attenuator to remain substantially in full contact with the top surface of said column of water as said attenuator moves up and down within said caisson.

9. The wave generator of claim 1, wherein said attenuator is substantially horizontally oriented and extends substantially across the width of said caisson, wherein the contact between said attenuator and said surface of said column of water helps to prevent wave action and unwanted water movements from occurring across the width of said caisson.

10. A wave generator for a wave pool comprising:

a caisson associated with a body of water within said wave pool, wherein said caisson has a column of water therein that communicates with said body of water;

a fan, blower or pump mechanism which introduces air into and out of said caisson and has the effect of causing said column of water to move up and down within said caisson;

a floating attenuator positioned on top of said column of water, extending substantially across the width of said caisson, wherein said attenuator is adapted to remain substantially in contact with the top surface of said column of water as it moves up and down within said caisson to help prevent wave action and unwanted water movements from occurring substantially across the width of said caisson; and a substantially vertically oriented post positioned inside said caisson which is extended through a hole in said attenuator, and wherein said attenuator is movably associated with said post, and wherein the association between said hole and said post helps to keep said attenuator in a substantially horizontal orientation as it travels up and down within said caisson.

11. The wave generator of claim 10, wherein said attenuator has a predetermined thickness, and said hole within said attenuator has a predetermined height, wherein a gap that extends between said post and said hole is less than one-fourth the distance of said height.

12. The wave generator of claim 10, wherein said attenuator is buoyant and has sufficient mass, density and weight to enable a bottom surface of said attenuator to remain substantially in full contact with the top surface of said column of water as said attenuator moves up and down within said caisson.

13. The wave generator of claim 10, wherein said attenuator is substantially horizontally oriented and helps to prevent wave action and unwanted water movements from occurring across the width of said column of water.

* * * * *